US012667199B1

(12) United States Patent
Galjour

(10) Patent No.: US 12,667,199 B1
(45) Date of Patent: Jun. 30, 2026

(54) SYSTEM FOR LIFTING AND RETAINING A MATTRESS

(71) Applicant: Benjamin Andrew Galjour, Tupelo, MS (US)

(72) Inventor: Benjamin Andrew Galjour, Tupelo, MS (US)

( * ) Notice: Subject to any disclaimer, the term of this patent is extended or adjusted under 35 U.S.C. 154(b) by 25 days.

(21) Appl. No.: 18/821,684

(22) Filed: Aug. 30, 2024

(51) Int. Cl.
*A47C 19/02* (2006.01)
*A47C 27/14* (2006.01)

(52) U.S. Cl.
CPC ..... *A47C 19/021* (2013.01); *A47C 27/146* (2013.01)

(58) Field of Classification Search
CPC ..... A47C 19/021; A47C 27/146
See application file for complete search history.

(56) References Cited

U.S. PATENT DOCUMENTS 3,245,092 A * 4/1966 Kreuz ..... A47C 17/82 5/660
3,266,062 A * 8/1966 Rogers ..... B60P 3/38 5/118
3,636,573 A * 1/1972 Bartz ..... A61G 7/015 5/660
3,742,527 A * 7/1973 Johnston ..... A61G 7/0516 D6/392
4,222,137 A * 9/1980 Usami ..... A47C 23/0435 5/935
4,644,593 A * 2/1987 O'Brien ..... A61G 7/0573 297/284.3
5,095,560 A * 3/1992 Volker ..... A47C 19/045 D12/128
5,381,572 A * 1/1995 Park ..... A47C 21/006 601/91
5,822,813 A * 10/1998 Powell ..... B63B 29/12 5/118
6,505,363 B2 * 1/2003 Davis ..... A47C 17/80 5/118
6,671,901 B2 * 1/2004 Zenczykowski ..... A47C 19/045 5/118
6,718,574 B1 * 4/2004 Bradley ..... B62D 33/0612 5/118
6,886,203 B2 * 5/2005 Drakos ..... A47C 21/028 5/660

(Continued)

FOREIGN PATENT DOCUMENTS

WO WO-2022125435 A1 * 6/2022 ..... A47C 27/148

*Primary Examiner* — David E Sosnowski
(74) *Attorney, Agent, or Firm* — George L Williamson

(57) ABSTRACT

Method and apparatus for lifting the four corners of a conventional mattress away from the foundation supporting the mattress and includes extendable and retractable lifting members that raise and lower the mattress near the four corners of the mattress. The base of the lifting member is supported on a frame member of the conventional foundation support for the mattress so that the upper end of the lifting member fits into a female receptacle like member on the underside of the mattress so that when the lifting member is extended the mattress becomes lifted away from the supporting foundation. The lifting member may include an electrical linear actuator having a body, a base, an electrical motor and a lifting member so that when the linear actuator is actuated the mattress is lifted away from and retained on the supporting foundation.

20 Claims, 3 Drawing Sheets

(56) References Cited

U.S. PATENT DOCUMENTS 6,993,798 B1 * 2/2006 Roberts ..... A47C 19/045 5/118
7,146,662 B1 * 12/2006 Pollard ..... A47B 91/16 5/118
7,730,567 B2 * 6/2010 Jaeger ..... A47C 21/028 5/658
8,484,774 B2 * 7/2013 Cohen ..... A47D 7/03 5/93.1
9,320,362 B1 * 4/2016 Shea ..... A47C 21/06
10,299,608 B1 * 5/2019 Shi ..... A47C 21/08
10,674,831 B1 * 6/2020 Braden ..... A47C 19/045
2002/0078500 A1 * 6/2002 Davis ..... A47C 17/80 5/118
2009/0044332 A1 * 2/2009 Parsell ..... A61G 7/012 5/11
2009/0211022 A1 * 8/2009 Harding ..... A47D 9/04 5/652
2010/0162482 A1 * 7/2010 Cohen ..... A47C 19/045 5/11
2010/0223722 A1 * 9/2010 Burnett ..... A47C 19/045 5/11
2013/0112832 A1 * 5/2013 Hilton ..... A47C 21/028 248/354.1
2013/0232698 A1 * 9/2013 Ward ..... A47C 21/00 5/659
2014/0159410 A1 * 6/2014 Rasmussen ..... B60P 3/39 296/24.33
2017/0079424 A1 * 3/2017 Lin ..... A47B 9/10
2018/0303256 A1 * 10/2018 Sturgeon ..... A47C 21/022
2019/0059601 A1 * 2/2019 Kramer ..... A47C 19/045
2020/0138200 A1 * 5/2020 Sharma ..... A47C 21/044
2021/0307529 A1 * 10/2021 Kim ..... A47C 20/041
2022/0313514 A1 * 10/2022 Kirtikar ..... A61G 7/015
2023/0025691 A1 * 1/2023 Neuenswander ..... A47C 20/10
2024/0138588 A1 * 5/2024 Da Silva Neto ..... A47D 9/012
2026/0000215 A1 * 1/2026 Bernier ..... A47C 27/006

* cited by examiner

SYSTEM FOR LIFTING AND RETAINING A MATTRESS

PRIOR ART

Devices relevant to the present invention have been described in the related art; however, none of the related art devices disclose the unique features of the present invention.

In U.S. Pat. No. 6,886,203, dated May 3, 2005, Drakos, et al., disclosed a mattress lifter. In U.S. Pat. No. 7,730,567, dated Jun. 8, 2010, Jaeger disclosed a mattress lifting device. In U.S. Patent Application Publication No. 2013/0112832, dated May 9, 2013, Hilton disclosed a system and method for supporting mattresses. In U.S. Pat. No. 3,636,573, dated Jan. 25, 1972, Bartz disclosed a foldable mattress support. In U.S. Pat. No. 3,245,092, dated Apr. 12, 1966, Kreuz disclosed an adjustable bedboard. In U.S. Pat. No. 9,320,362, dated Apr. 26, 2016, Shea disclosed a mattress corner lifting device.

While these devices may be suitable for the purposes for which they were designed, they would not be as suitable for the purposes of the present invention as hereinafter described. As will be shown by way of explanation and drawings, the present invention works in a novel manner and differently from the related art.

BACKGROUND OF THE INVENTION

The present invention relates generally to beds and mattresses and, more particularly, is concerned with a device for lifting the four corners of a mattress.

SUMMARY OF THE INVENTION

The present invention discloses a system for lifting the four corners of a conventional mattress away from the foundation supporting the mattress. The present invention includes a set of four extendable and retractable lifting members that raise and lower the mattress proximate the four corners of the mattress. The base of the lifting member is supported on a frame member of the conventional foundation support for the mattress so that the upper end of the lifting member fits into a female receptacle like member on the underside of the mattress so that when the lifting member is extended the mattress becomes lifted away from the supporting foundation. The lifting member includes an electrical linear actuator having a body, a base, an electrical motor and a lifting member so that when the linear actuator is actuated the mattress is lifted away from the supporting foundation.

An object of the present invention is to provide a system for lifting the ends of the mattress at the corners away from the foundation upon which the mattress is supported. A further object of the present invention is to provide a system for lifting the corners of a mattress high enough to allow for a person to change the sheets on the mattress. A further object of the present invention is to provide a mattress retainer so that the mattress does not slide downwardly along an adjustable base because the posts of the lifting members prevent the mattress from sliding by having the upper end of the lifting member be disposed in female receptacles on the underside of the mattress. A further object of the present invention is to provide a system for lifting a mattress which can be easily operated by a user. A further object of the present invention is to provide a system for lifting a mattress which can be easily and inexpensively manufactured.

The foregoing and other objects and advantages will appear from the description to follow. In the description reference is made to the accompanying drawings, which form a part hereof, and which are shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF DRAWINGS

In order that the invention may be more fully understood, it will now be described, by way of example, with reference to the accompanying drawings in which.

DETAILED DESCRIPTION OF THE INVENTION

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 6 illustrate the present invention wherein a system for lifting a mattress is disclosed and which is generally indicated by reference number 10.

Figure 1:
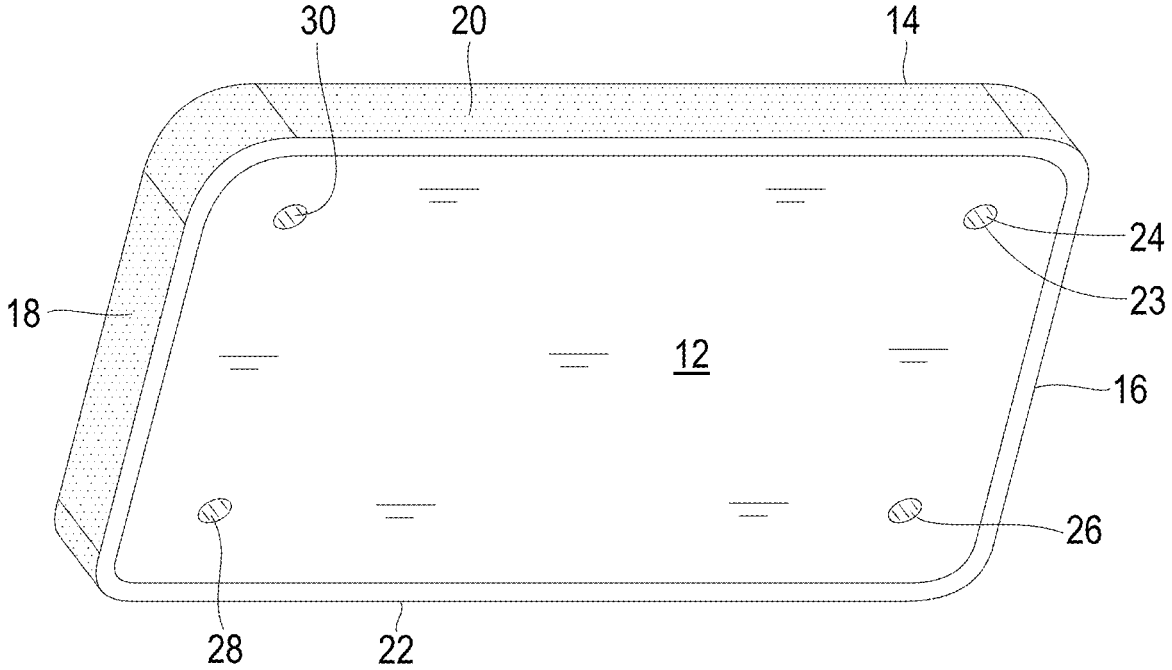
FIG. 1 is a perspective view of the underside of the mattress.

Turning to FIG. 1, therein is shown a perspective view of the underside 12 of a generally rectangular shaped convention mattress 14 having an upper end 16 along with a lower end or foot 18 and a right side 20 along with a parallel left side 22 being generally rectangularly shaped as a conventional mattress. Also shown are a plurality of cup-like female receptacles generally indicated by numeral 23 and more specifically numbered 24, 26, 28, and 30 being placed proximate to the four corners of the mattress 14. The mattress 14 is expected to range in sizes of width of about 38 inches to about 76 inches and of length of about 70 inches to about 84 inches with the thicknesses ranging from about 6 inches to about 14 inches. The receptacles 23 are expected to range between about ½ inch to about 1.5 inches long and about ¾ inches to about 2 inches in diameter with the receptacles 23 being positioned proximate to or about 6 to 8 inches from the sides 20, 22 or ends 16, 18 of the mattress 14.

Figure 2:
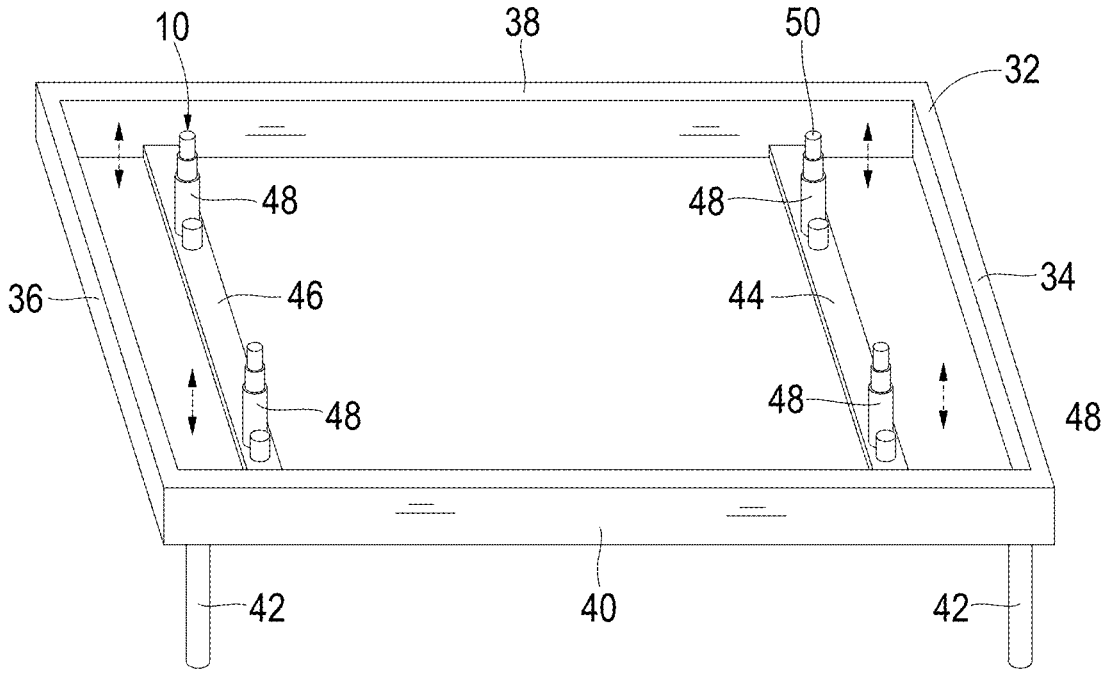
FIG. 2 is a perspective view taken from above of a conventional mattress foundation as would be used with the present invention.

Turning to FIG. 2, therein is shown a perspective view of a supporting foundation 32 which would be used to support a mattress 14 as used with the present invention 10. The foundation 32 has an upper end 34, a lower end or foot, 36, a left side 38 and a right side 40 along with a plurality of supporting legs 42 shown proximate the corners as would be done in the standard manner by one skilled in the art. Also shown are exemplary frame members being cross members 44,46 an upper cross member 44 and a lower cross member 46 supporting a plurality of lifting members 48 which are disposed proximate to the corners of a conventional mattress, such as a convention mattress 14 shown in FIG. 1, noting that the lifting members have an upper end 50 which would be strategically placed so as to cooperate with the plurality of receptacles 24 disposed in the mattress 14. When the lifting member 48 are in an extended position the top end 50 would enter the receptacle 23 so that the corners of the mattress 14 would be lifted upwardly away from the foundation 32. The lifting members 48 could be actuated simultaneously or individually to life a user selected portion of a mattress 14 ranging from one to four corners of a mattress 14. Exemplary frame members 44, 46 could be cross members as shown in FIG. 2, or the frame members could be coexistent with side members 38, 40 or end members 34, 36 or the frame members 44, 46 could extend between these members in various connection patterns.

Figure 3:
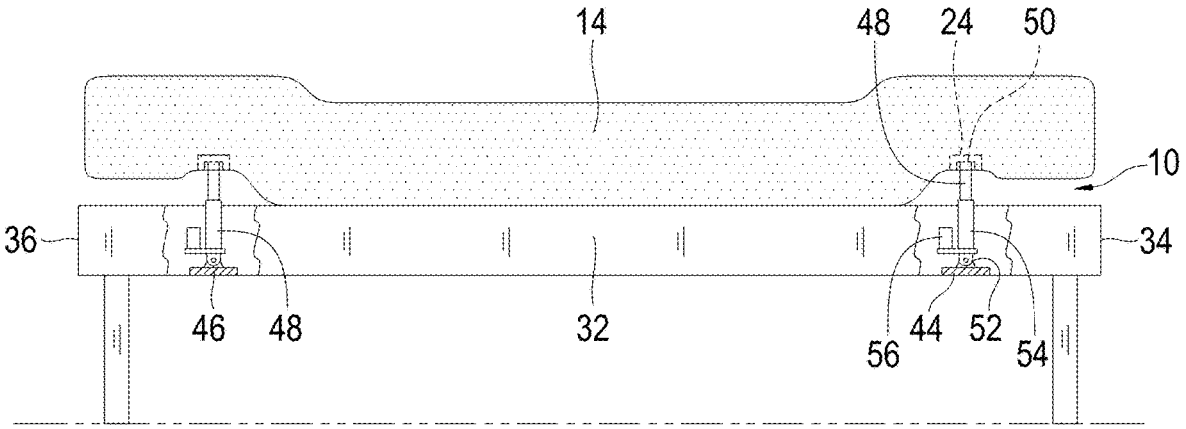
FIG. 3 is a side elevation view of the present invention shown in operative connection

Turning to FIG. 3, therein is shown a side view of the supporting foundation 32 supporting a mattress 14 as used with the present invention 10. The framework of the foundation 32 has an upper end 34 and a lower end or foot 36 along with a plurality of supporting legs 42 shown at the corners as would be done in the standard manner by one skilled in the art. Also shown are a plurality of lifting members 48 which are disposed proximate to the corners of the mattress 14 noting that the lifting members have an upper end 50 which would be strategically placed so as to cooperate with the plurality of receptacles 24 disposed in the mattress 14. When the lifting member 48 is in an extended position the top end 50 would enter the receptacle 23 so that the corners of the mattress 14 would be lifted upwardly away from the foundation as shown. It should be clear that the top end 50 of the lifting member 48 is sized, shaped and spaced to cooperate with the receptacle 23 of the mattress 14 and is disposed on an appropriate frame member of the foundation 32 such as cross frame member 44. The lifting member 14 also includes a base 52 along with a body or enclosure 54 wherein the linear actuator is driven by an electrical motor 56 having the appropriate electrical connections 58 as would be done in the standard manner by one skilled in the art. Lifting member 14 could also include an appropriately shaped and sized bracket (not shown) which could be used for mounting the lifting member on an appropriate frame member such as 34, 36, 38, 40, 44 or 46 of the foundation 32.

Figure 4:
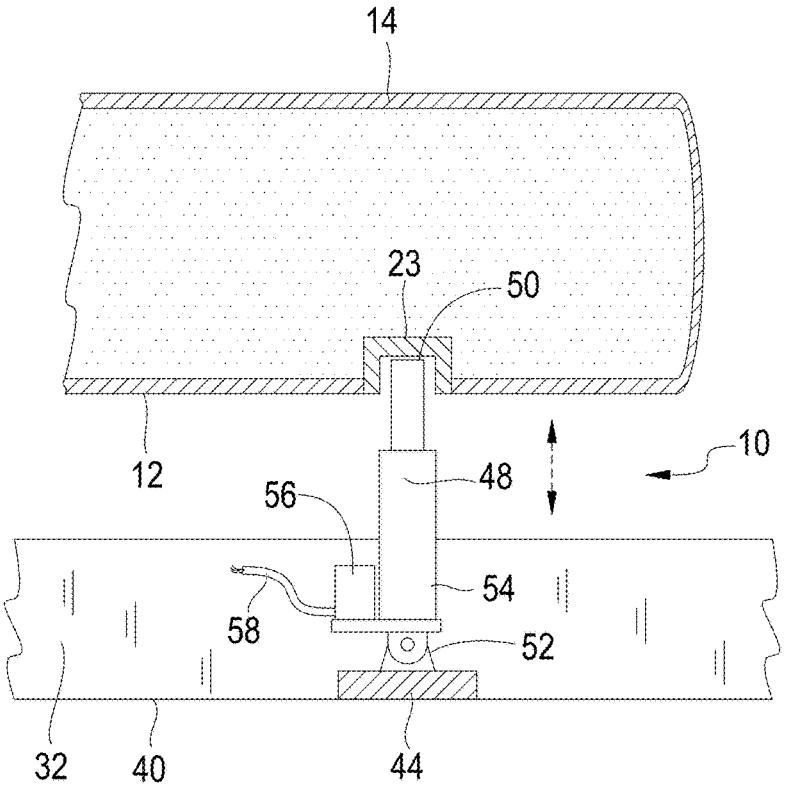
FIG. 4 is a detailed side view of an exemplary lifting member of the present invention shown in operative connection.

Turning to FIG. 4, therein is shown a detailed view of a mattress 14 on top of a supporting foundation 32 having side rail 40 wherein an exemplary cross member 44 is supporting a lifting member 48. Each lifting member 48 has an upper end 50 which would be strategically placed so as to cooperate with the plurality of receptacles 24 and the mattress 14. When the lifting member 48 is in an extended position the top end 50 enters the receptacle 23 so that the corners of the mattress 14 would be lifted upwardly away from the foundation 32. It should be clear that the top end 50 of the lifting member 48 is sized, shaped and spaced to cooperate with the receptacle 23 of the mattress 14. The lifting member 14 also includes a base 52 along with a body or enclosure 54 wherein the linear actuator is driven by an electrical motor 56 having the appropriate electrical connections 58 as would be done in the standard manner by one skilled in the art.

Figure 5:
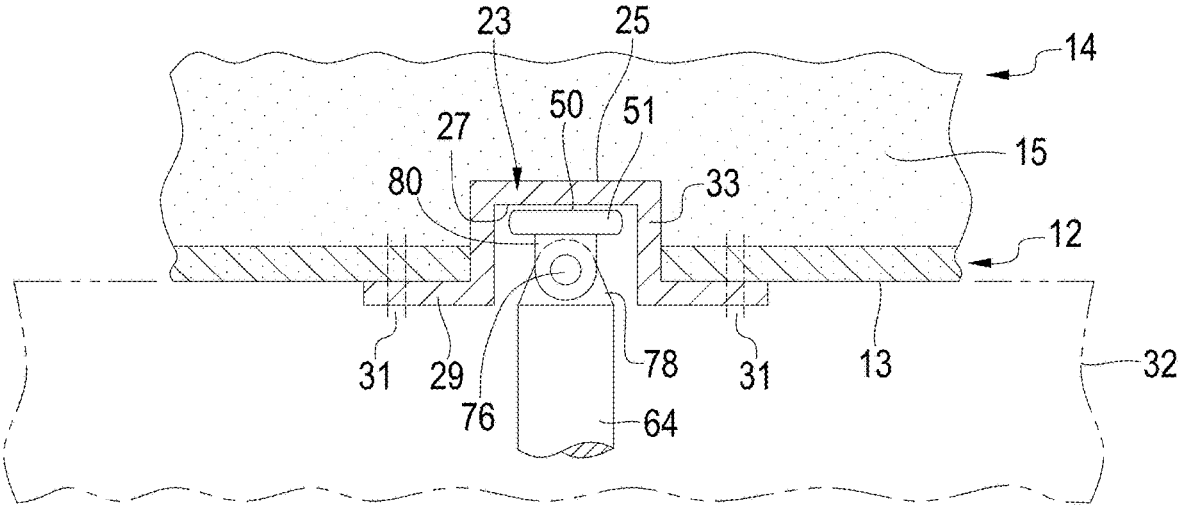
FIG. 5 is an enlarged cross-sectional view of portions of the present invention.

Turning to FIG. 5, therein is shown an enlarged view of portions of the present invention 10 including the mattress 14 having an interior portion 15 wherein the underside 12 of the mattress 14 includes a bottom sheet portion 13 of the mattress as is commonly provided. Shaft 64 of the lifting member is shown in the retracted position with the mattress 14 resting on and supported by the foundation 32. Also shown is a receptacle 23 or cup being downwardly disposed wherein the cup 23 has a bottom portion 25 having an inner surface 27 along with a wall 33 extending downwardly to a circumferential rim 29 wherein the rim 29 is attached to the bottom sheet 13 by being sewn with stitches or ultrasonically welded as indicated at 31 so that the cup 23 is securely attached to the mattress 14. It can be seen that the shaft 64 of the lifting member 48 has a top plate 51 wherein the top end 50 of the top plate 51 contacts the inner surface 27 of the cup 23 in order for the mattress 14 to be lifted upwardly by the lifting member 48. The shaft 64 also has on its upper end a boss 78 which mechanically cooperates with arm 80 of the top plate 51 so that it can pivot about a pivot point or axle 76 so that the mattress 14, if necessary, can be lifted at an angle to the horizontal plane; providing pivot point 76 makes the lifting member 48 more compatible with mattresses of various firmness so as to prevent the top end 50 from puncturing the bottom sheet 13 or underside 12 of the mattress 14. Foundation support 32 is also shown in phantom line in the background.

Figure 6:
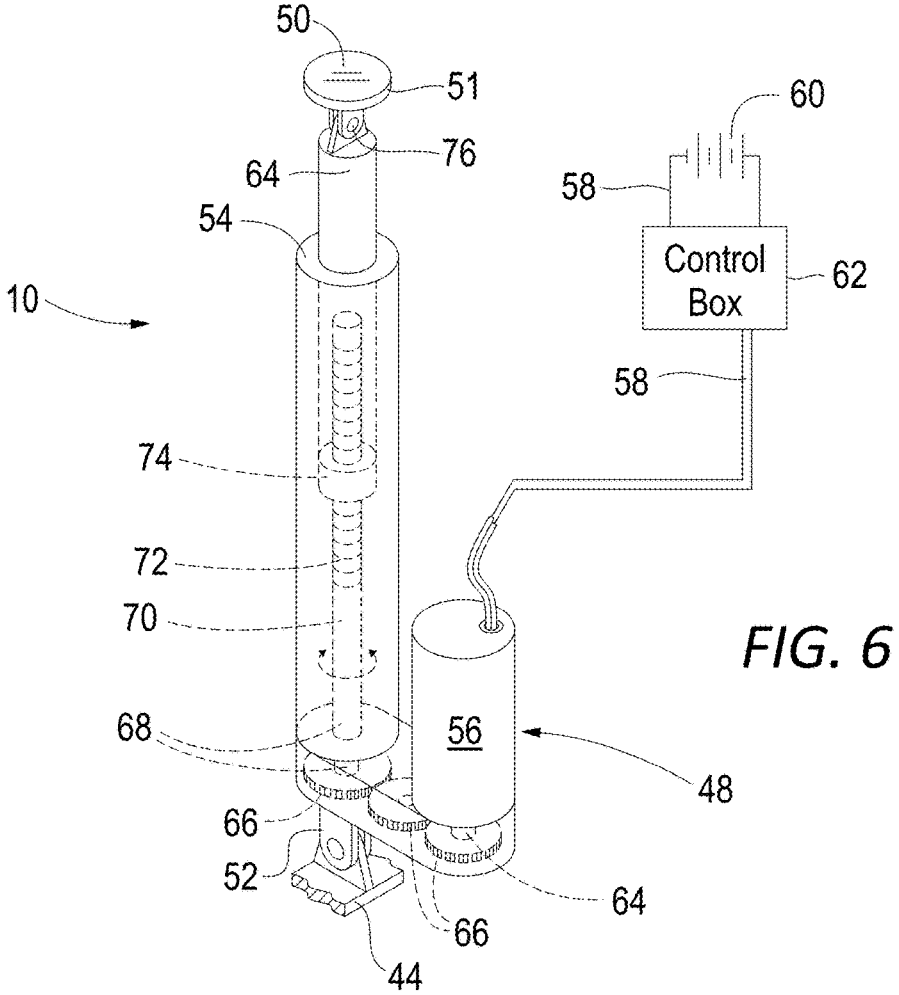
FIG. 6 is a detailed perspective view of an exemplary linear actuator.

Turning to FIG. 6, the present invention 10 operates on any appropriate conventional electrical system which could be either AC or DC and could be supplied by any suitable source such as electrical power supply 42, e.g., a battery. Electrical power from the electrical power supply 60 is supplied to a control box 62, i.e., an electrical controller, through electrical wiring harness 58. The present invention 10 includes an enclosure 54. Shaft 64 with pivotable top end 50 is extended and retracted into the housing 54 by means of a linear actuator generally indicated by reference number 48 including a drive motor 56 having a rotating output drive shaft 64 with a set of gears forming a gear assembly 66 in a gear box or enclosure wherein one of the gears has another rotating output drive shaft 68 wherein the drive shaft 68 is mechanically coupled to a threaded ball screw/spindle 70 having a set of threads 72 thereon which threads 72 are interconnected to mating threads on a ball nut 74 so that as the threaded ball screw/spindle 70 is rotated by the drive motor 56, the ball nut 74 moves linearly along the screw/spindle 70. Ball nut 74 is interlocked to the cover or enclosure 54 to prevent its rotation so that the shaft 64 moves linearly along the enclosure 54 as the threaded ball screw/spindle 70 rotates and thereby extends and retracts the top end 54 into and out of the enclosure 54 in response to the rotation of motor 56 in either a clockwise or a counterclockwise direction. Base 52 is shown being optionally pivotably attached to frame member 44.

Continuing with FIG. 6, an electrical controller 62 could be an electromechanical or electrical circuit or system that can control some function by transmitting signals through a conductor (hard wire) or the air (wireless). Control may be carried out by audio, radio, a cue stick, or infrared transmission. Examples of controllers include infrared TV/stereo/VCR remotes, and radio controllers for opening doors or controlling model airplanes, cars, boats, or motors 56 or other suitable user interface and may be handheld. It may be synonymous with a microcontroller which is a monolithic integrated circuit with a complete central processing unit (CPU) and enough semi conductor memory (our a.m., ROM, E PROM, are EE PROM) and input-output (I/O) capability to be considered as equivalent to a "computer on a chip." Because of its limited memory, a microcontroller is usually used in control rather than data processing applications. A motor controller could be a device or group of devices that can coordinate in a predetermined manner the performance of an electrical motor such as motor 56. A motor controller might include a manual or automatic means for starting and stopping the motor 56, selecting forward or reverse rotation, selecting and regulating the speed, regulating or limiting the torque, and protecting against overloads and electrical faults. Motor controllers may use electromechanical switching, or may use power electronics devices to regulate the speed and direction of a motor 56.

By way of summary and with reference to FIGS. 1-6, the present invention 10 discloses a method for lifting and retaining a mattress 14, the mattress being supported on a foundation 32 of a bed and includes a mattress being generally rectangular shaped and having a plurality of corners with a plurality of downwardly disposed receptacles 23 on an underside 12 of the mattress with one receptacle being proximate to each corner with a foundation underneath the mattress for supporting the mattress, the foundation having a plurality of frame members 34, 36, 38, 40, 44, 46 along with mounting a lifting member 48 on one of the frame members, the lifting member having a retracted position and an extended position, an upper end 50 of a shaft 64 extending from the lifting member configured for insertion into one of the receptacles when the lifting member is in the extended position and wherein the mattress is lifted above and retained on the foundation when the lifting member is in the extended position. Also, a lifting member is disposed proximate each corner of the mattress, wherein the lifting member further comprises a linear actuator 48. The linear actuator 48 further comprises a threaded ball screw 70 connected at a distal end thereof to a proximal end of the shaft 64, with a cover or body 54 enclosing the ball screw 70, a ball nut 74 interlocked to the cover to prevent rotation of the ball nut, the ball nut threadably engaged with the ball screw so that the ball nut moves linearly along the ball screw when the ball screw is rotated, so that movement of the ball nut along the ball screw causes the shaft to either extend or retract depending on direction of rotation of the ball screw and wherein the upper end of the shaft is pivotable at 76.

The invention claimed is:

1. A system for lifting and retaining a mattress, the mattress being supported on a foundation, comprising:

a) a mattress being generally rectangular shaped and having a plurality of corners;

b) a plurality of downwardly disposed receptacles embedded on an underside of said mattress, so that one said receptacle is proximate to each said corner;

c) a foundation disposed underneath said mattress for supporting said mattress, said foundation having a plurality of frame members;

d) a lifting member disposed on one of said frame members, said lifting member including a shaft having a retracted position and an extended position, an upper end of said shaft extending from said lifting member and configured for insertion into one of said receptacles when said lifting member is in said extended position; and e) wherein said mattress is lifted above and retained on said foundation when said lifting member is in said extended position.

2. The system of claim 1, wherein one said lifting member is disposed proximate each said corner of said mattress.

3. The system of claim 1, wherein said lifting member further comprises a linear actuator.

4. The system of claim 2, wherein said lifting members operate independently.

5. The system of claim 2, wherein said lifting members operate simultaneously.

6. The system of claim 1, further comprising an electrical controller for controlling the operation of said lifting member.

7. The system of claim 3, wherein said linear actuator further comprises a threaded ball screw connected at a distal end thereof to a proximal end of said shaft, a cover enclosing said ball screw, a ball nut interlocked to said cover to prevent rotation of said ball nut, said ball nut threadably engaged with said ball screw so that said ball nut moves linearly along said ball screw when said ball screw is rotated, so that movement of said ball nut along said ball screw causes said shaft to either extend or retract depending on direction of rotation of said ball screw.

8. The system of claim 1, wherein said plurality of receptacles are attached to said mattress by sewing.

9. The system of claim 1, wherein said plurality of receptacles are attached to said mattress by ultrasonic welding.

10. The system of claim 1, wherein said upper end of said shaft is pivotable.

11. A method for lifting and retaining a mattress, the mattress being supported on a foundation, comprising the steps of:

a) providing a mattress being generally rectangular shaped and having a plurality of corners;

b) providing a plurality of downwardly disposed receptacles embedded on an underside of the mattress, so that one receptacle is proximate to each corner;

c) providing a foundation underneath the mattress for supporting the mattress, the foundation having a plurality of frame members;

d) mounting a lifting member on one of the frame members, the lifting member including a shaft having a retracted position and an extended position, an upper end of the shaft extending from the lifting member and configured for insertion into one of the receptacles when the lifting member is in the extended position; and e) wherein the mattress is lifted above and retained on the foundation when the lifting member is in the extended position.

12. The method of claim 11, further comprising the step of mounting one said lifting member proximate each corner of the mattress.

13. The method of claim 11, wherein the lifting member further comprises a linear actuator.

14. The method of claim 12, wherein the lifting members operate independently.

15. The method of claim 12, wherein the lifting members operate simultaneously.

16. The method of claim 11, further comprising the step of providing an electrical controller for controlling the operation of the lifting member.

17. The method of claim 13, wherein the linear actuator further comprises a threaded ball screw connected at a distal end thereof to a proximal end of the shaft, a cover enclosing the ball screw, a ball nut interlocked to the cover to prevent rotation of the ball nut, the hall nut threadably engaged with the ball screw so that the ball nut moves linearly along the ball screw when the ball screw is rotated, so that movement of the ball nut along the ball screw causes the shaft to either extend or retract depending on direction of rotation of the ball screw.

18. The method of claim 11, wherein the plurality of receptacles are attached to the mattress by sewing.

19. The method of claim 11, wherein the plurality of receptacles are attached to the mattress by ultrasonic welding.

20. The method of claim 11, wherein the upper end of the shaft is pivotable.

* * * * *